United States Patent [19]

Kothe et al.

[11] 4,252,180

[45] Feb. 24, 1981

[54] PRESSURE RELIEF APPARATUS FOR THE SUPPORTING BEAM FOR METAL STRAND CASTING PLANTS, PARTICULARLY CURVED STEEL STRAND CASTING PLANTS

[75] Inventors: Dieter Kothe, Moers; Siegfried Dangeleit, Krefeld, both of Fed. Rep. of Germany

[73] Assignee: DEMAG Aktiengesellschaft, Fed. Rep. of Germany

[21] Appl. No.: 3,369

[22] Filed: Jan. 15, 1979

[30] Foreign Application Priority Data

Feb. 15, 1978 [DE] Fed. Rep. of Germany ..... 2806317

[51] Int. Cl.[3] ..... B22D 11/128

[52] U.S. Cl. ..... 164/448; 72/245; 72/248

[58] Field of Search ..... 164/448, 442; 72/245, 72/248

[56] References Cited

U.S. PATENT DOCUMENTS

| | | | |
|---|---|---|---|
| 3,362,204 | 1/1968 | Scott | 72/245 |
| 3,435,649 | 4/1969 | O'Brien | 72/245 X |
| 3,438,235 | 4/1969 | Elton | 72/248 X |
| 3,659,450 | 5/1972 | Metzger | 72/245 |
| 3,757,848 | 9/1973 | Scholz et al. | 164/448 |
| 3,858,425 | 1/1975 | Thompson | 72/245 |
| 3,910,090 | 5/1975 | Lorenz | 72/245 |
| 4,007,618 | 2/1977 | Ponter | 72/245 |
| 4,007,822 | 2/1977 | Scheurecker | 164/448 |

FOREIGN PATENT DOCUMENTS

| | | | |
|---|---|---|---|
| 227645 | 5/1963 | Austria | 72/248 |
| 2612094 | 10/1976 | Fed. Rep. of Germany | 164/448 |

*Primary Examiner*—Robert D. Baldwin
*Assistant Examiner*—J. Reed Batten, Jr.
*Attorney, Agent, or Firm*—Mandeville and Schweitzer

[57] ABSTRACT

A pressure release device is provided for metal strand casting plants to relieve the pressure between opposed sets of supporting rolls for the strand in instances where unusual pressure build-up takes place between the opposed sets of rolls. The device is simple and inexpensive and may be positioned in the axis of the connecting rods between two opposed roll stands. The device accommodates a regular mechanical spindle-threaded nut spacing arrangement, which may be manually adjusted and avoids the problem of "freezing" which is common with such devices using a "built-in" frictional release arrangement.

7 Claims, 4 Drawing Figures

(A-A) (B-B)

PRESSURE RELIEF APPARATUS FOR THE SUPPORTING BEAM FOR METAL STRAND CASTING PLANTS, PARTICULARLY CURVED STEEL STRAND CASTING PLANTS

BACKGROUND AND DESCRIPTION OF THE INVENTION

The invention refers to a pressure relief apparatus at a supporting element beam for metal strand casting plants, particularly for curved steel strand casting plants, which is set for the strand vein width essentially by means of connecting rods, spacer pieces, and arrestable adjustment devices arranged next to the strand cross section, or which may be set for the distance matching the desired strand thickness between opposed supporting elements and tightened at the supporting element frame.

Such supporting element beams require exact adjustment to the respective strand shape, and simultaneously require simple resetting procedures for altered strand thickness. The distance set between two respective supporting elements (which consist, in the area of the casting strand leaving the strand casting molds, of sheet-like bodies, and in the remaining areas, of rollers or of a number of rollers assembled on an axis) must ensure absolute guidance for the casting strand which still has liquid in the interior.

It is known to arrange cylinders with cooperating helical surfaces, such as grooved spindles with cooperating threaded nuts, in the axis of the connecting rods to fulfill the requirement of easy adjustment of the supporting rollers. The angle of inclination of the helical surfaces must be smaller than the pertaining or built-in friction at rest. The slide cylinders may be synchronously driven by means of hydraulic cylinders according to German Pat. No. 26 12 094 in order to adjust the supporting roller distance. This arrangement requires self-checking or built-in friction of the helical slide surfaces according to the thread pitch of a threaded spindle. Such self-checking is disadvantageous in those cases where the casting strand solidifies irregularly, and exerts increased forces onto the supporting rollers when traversing the supporting roller stand. The forces occurring then cannot be predetermined mathematically with sufficient accuracy. With basic unanticipated forces it is, therefore, not inconceivable that the relief apparatus is blocked at the moment when it should be operating.

Another disadvantage results from the extreme case when the casting strand further cools at a standstill in the supporting roller stand due to interruption of the casting process and finally completely solidifies and exerts further expansion forces onto the supporting rollers. This case is especially applicable to curved metal strand casting plants. The expansion forces increase the friction on the slide surfaces of the spacer cylinders. The adjustment of the spacer cylinders then requires, accordingly, large drives, thus not only causing greater expenditures, but also a considerable space requirement.

Another problem with current technology is the basic choice of a hydraulic or purely mechanical drive to position the supporting element beams towards the strand vein, and/or to adjust the strand thickness, and/or to adjust the distance between opposite supporting elements. Another disadvantage in current technology for hydraulically operating means of adjustment is that self-checking spacing spindles, for example, may be released by a breakdown of hydraulic pressure in the piston-cylinder units. The application of a spacing cylinder with a built-in check thus requires a hydraulic adjusting drive for the supporting element beams. This means that it is not possible to use a self-checking spacing cylinder when using mechanical means of adjustment, such as traction spindles with threaded nuts. It has been found that the increase in clamping force caused by return forces of the casting strand onto the supporting elements, leads to an increase in the self-checking thread forces, so that movement of the threaded nut on the threaded spindle is prevented.

Based on this, the present invention relates to a relief apparatus without the above-mentioned shortcomings, i.e. requiring less expenditures and less space and which, at the same time, functions safely and is particularly suitable for support element beams which are adjusted to the strand vein by means of arrestable mechanical adjusting elements.

According to the invention, within the power flow going through the connecting rod, a switch-on, switch-off power link is provided with which to detach at least one supporting element beam of a supporting element beam pair from its bracing support by switching off the power link. Such power link may be incorporated within the connecting rod/threaded spindle/threaded nut arrangement in such a way that it will not require any additional space. The power link according to the invention is also safer in operation, as it is structured on the existing clamping force of the cast strand. That is, it depends on the magnitude of the clamping force. In principle, the power link permits the application of a relief apparatus with supporting element beams which are equipped with mechanical means of adjustment.

Following the basic idea of the invention, a short-stroke piston-cylinder unit with a valve blocking the discharge of pressure medium is arranged as a switch-on, switch-off power link between the supporting element beams and supporting element frames braced by means of supports and/or threaded spindles and threaded nuts. The concept of the invention requires merely a minimum volume filled with pressure medium, leaving a clearance of about 30 mm which suffices to transport the cast strand without difficulty away from between two opposed supporting elements.

Another space-saving feature results from the threaded nut existing in mechanical adjusting drives which the present invention uses, in that the switch-on, switch-off power link is arranged within the threaded nut of a threaded spindle/threaded nut arrangement transmitting the arresting force, such power link consisting of an annular cylinder with annular piston. In the sense of the compact construction of the power link it is, furthermore, advantageous if a viscous material, such as grease, is used as pressure medium in the piston-cylinder unit.

The operation of the power link, according to the invention, includes the outlet lock valve arranged outside the cooling chamber of the strand casting plant and connected with the piston-cylinder unit via a pressure line. The outlet lock valve may be set for a certain pressure, so that the relief apparatus is automatically started when this pressure is exceeded. On the other hand, the outlet lock valve may also be controlled manually and its effective range altered in accordance with the cooling status of a particular cast strand.

In very difficult cases, e.g. with curved metal strand casting plants with a great curvature, a greater relief of the supporting element beam, i.e. greater application of the supporting rollers, may be desired than that which is achieved by means of the power link and its short stroke. In that case, the invention includes an additional measure where, between the threaded nut and the supporting element frame, a rotatable spacer cylinder surrounding the shaft of the threaded nut is arranged, supported on the annular piston and the supporting element frame, whereby the spacer cylinder is axially displaceable in one peripheral position only. After activating the power link, and turning the spacer cylinder into the indicated peripheral position, the respective supporting element beam may, without any difficulty, be removed from the counter supporting element by means of a crane, hydraulic plunger, or similar device, to a desired opening position with the desired spacing.

The distance between the opposed supporting elements and/or the opposed supporting element beams is maintained by inserting U-shaped adapters at the supporting element frame between an annular collar or extension on the threaded spindle, and a contact surface.

An example of the invention is shown on the drawing and is explained as follows:

DETAILED DESCRIPTION OF THE INVENTION

Figure 1:
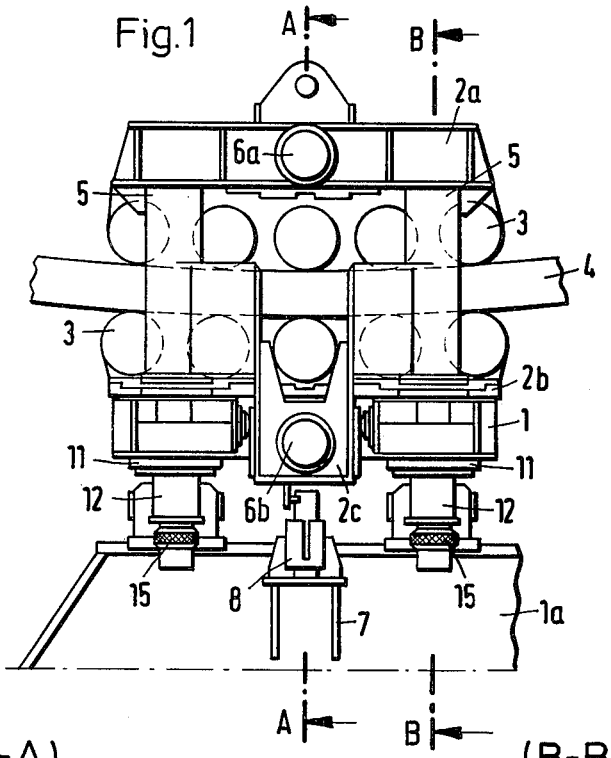
FIG. 1 is a side elevational view of a metal strand casting plant of the type having several supporting roll stands, and showing one such stand.

The metal strand casting plant consists in its supporting area of one single or of several supporting element frames 1. The supporting element frames 1 rest on stands 1*a* which, in turn, rests on a foundation (not shown). Each supporting element frame 1 has two opposed supporting element beams 2*a* and 2*b*, as usual. The supporting element beams 2 are provided with supporting rollers 3, a group of which is provided on each side of the cast strand 4 (in the example given here, five supporting rollers are drawn). At least one of the supporting element beams 2*a*, 2*b* is adjustable, and set for the strand vein formed by the supporting rollers 3, its width matching the desired thickness of the cast strand 4.

Figure 2:
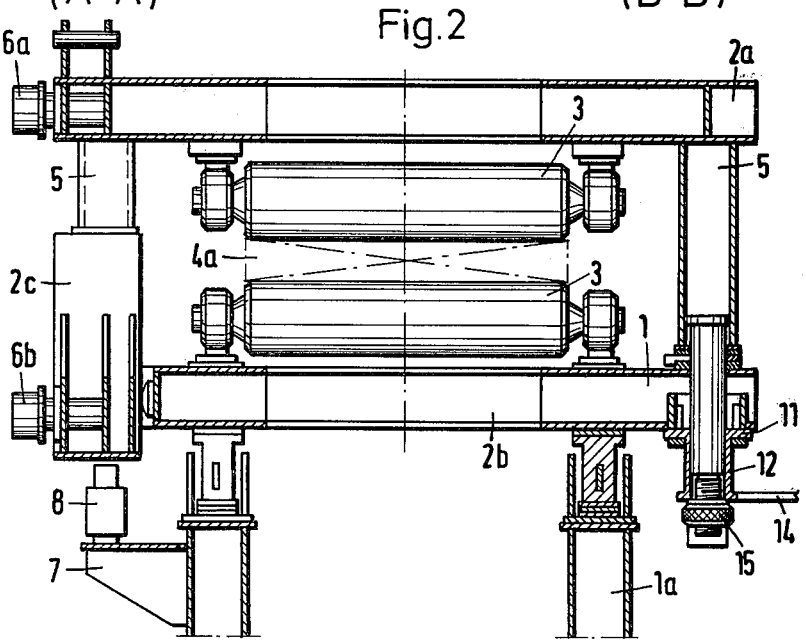
FIG. 2 is a cross sectional view of two portions of FIG. 1, with the left hand portion taken along lines A—A of FIG. 1, and the right hand portion taken along lines B—B of FIG. 1.

Setting is done by means of two pairs of connecting rods 5, turning supporting element frame 1 into a rigid structural part, which may be removed from the strand casting plant on wheels 6*a*, 6*b* and rails (not shown). Frame 1*a* is further equipped with brackets 7 serving as a firm base for hydraulic plungers 8. Plungers 8 lift the adjustable supporting element beam 2*a* to a new position. The power action for the necessary plunger pair is formed by a lateral projection 2*c*, centrally attached to supporting element frame 1, such projection 2*c* being firmly connected to supporting element beam 2*a* by means of reinforcing wall plates, fins, or similar connections. According to the support of the weight of supporting element beam 2, plungers 8 and projections 2*c* are provided in pairs. The dimensions of the supporting element beams 2 are adapted to the dimensions of the greatest strand cross section 4*a* to be cast in the metal strand casting plant (FIG. 2).

Figure 3:
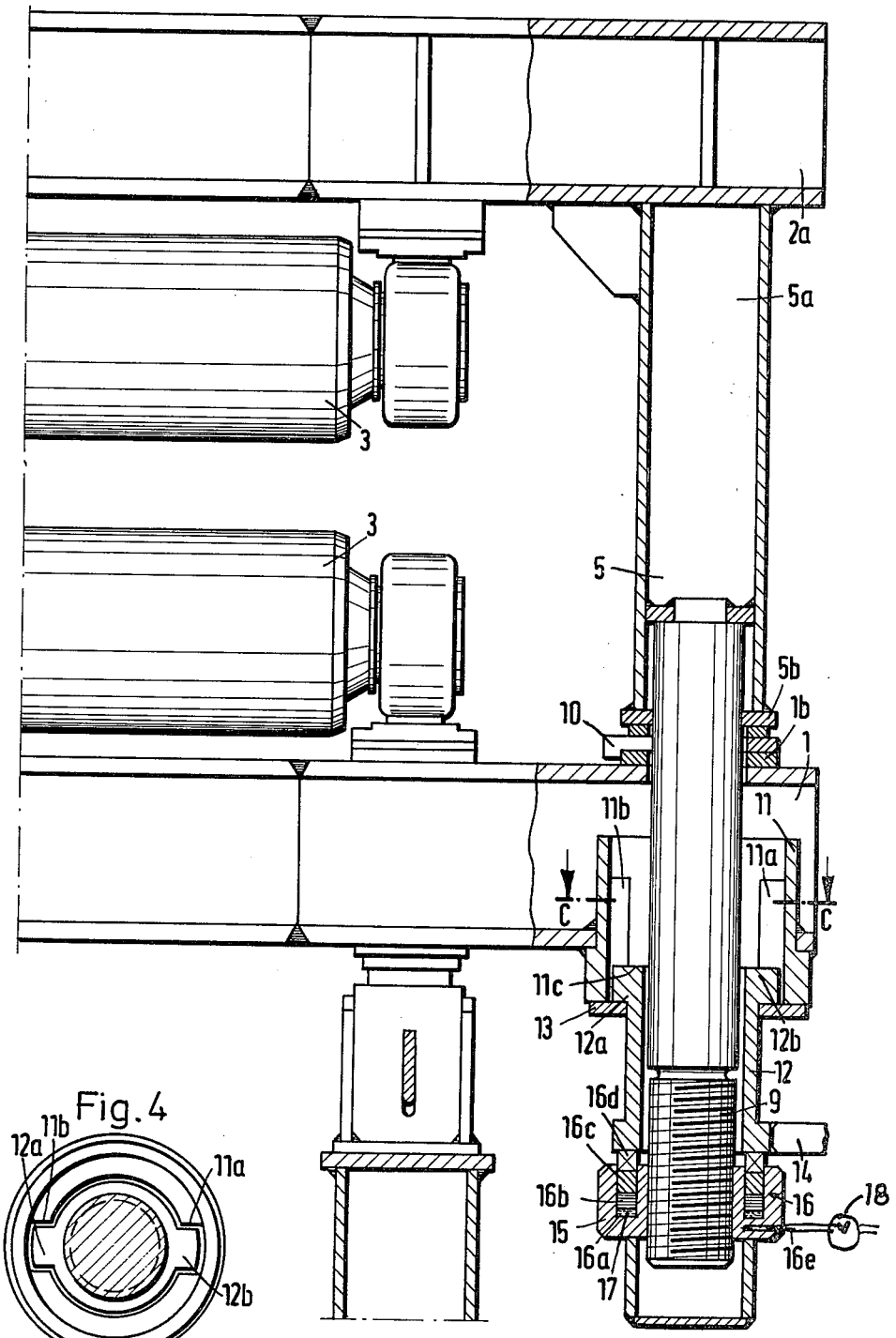
FIG. 3 is an enlarged showing of the right hand portion of FIG. 2.
Figure 4:
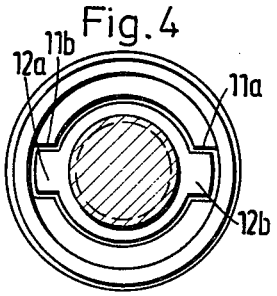
FIG. 4 is a sectional view taken along lines C—C of FIG. 3.

The structure of the connecting rod 5 is explained in some detail in FIG. 3. The supporting element beam 2*a* and the support 5*a* form a rigid connection, to which threaded spindle 9 is also attached. To this end, support 5*a* rests with the annular extension 5*b* connected to threaded spindle 9 on U-shaped adapters 10, and the latter rest on the contact surface 1*b* of the supporting element frame 1. Supporting element frame 1 has a rigidly arranged ring 11 in whose interior grooves 11*a*, 11*b* are provided with extensions 12*a*, 12*b* of spacer cylinder 12 sliding along the grooves 11*a*, 11*b* (FIG. 4). Extensions 12*a*, 12*b* are not in grooves 11*a*, 11*b* in normal position, but rather in a hollow 11*c*, preventing axial movement of the spacer cylinder 12 in the interior of ring 11. On the outside, end plate 13 safeguards the spacer cylinder 12 against displacement.

The spacer cylinder 12 may be turned manually by means of handle 14. Threaded nut 15 produces the tensing force necessary to tighten the supporting element beam 2*a* against the supporting element beam 2*b*. The interior of threaded nut 15 houses the power link 16 consisting of an annular cylinder 16*a*, annular pistons 16*b*, 16*c* and gasket 16*d*, as well as valve pressure line 16*e* with pressure relief valve 18. The pressure medium in the annular cylinder 16*a* consists of a viscous material 17, such as grease. During the casting of strand 4 the valve 18 for line 16*e* is closed and opens if the pressure exceeds permissible limits.

The relief apparatus operates as follows: as soon as the cast strand 4 presses against pitching supporting rollers 3 to an excessive degree due to a hardened spot, such as a thickening, or in the case of cooling due to standstill of the metal strand casting plant, the pressure of pressure medium 17 in annular cylinder 16*a* starts to rise. If the permissible limit is exceeded, the outlet lock valve 18 connected to pressure line 16*e* switches to "open", so that the pressure medium escapes, whereby the annular cylinder 16*a* moves over annular piston 16*b*. The distance of movement may be about 30 mm. With this movement, threaded spindle 9, and thus supporting element beam 2*a* also advance and the distance between the opposed supporting rollers 3 on each side of the strand increases. In this position, it is easy to turn the spacer cylinder 12 at the handle 14 until extensions 12*a* and 12*b* are aligned with grooves 11*a*, 11*b*. In this position, axial movement of spacer cylinder 12 is possible. Plungers 8 are now able to lift supporting element beam 2*a* until cast strand 4 may be further transported between the supporting rollers 3 without jamming.

We claim:

1. Pressure relief apparatus for the supporting roll frames of metal strand casting plants having a cast strand path, comprising (a) opposed supporting elements positioned on each side of said cast strand path;

(b) a plurality of connecting means extending between said opposed supporting elements;

(c) adjusting means for each of said connecting means for selectively adjusting the spacing between said opposed supporting elements; the improvement characterized by (d) means in association with said adjusting means for fixing the selected spacing between said opposed supporting elements;

(e) pressure medium power means located within said fixing means, said pressure medium power means providing a power link located along the longitudinal axis of said connecting means; and (f) means for discharging said pressure medium power means within said longitudinal axis of said connecting means at a pre-set pressure build-up occurring between said opposed supporting elements.

2. The apparatus of claim 1, further characterized by each of said connecting means including (a) a cooperating spindle and threaded nut;

(b) said pressure medium power means including a short stroke piston and cylinder unit; and (c) said discharging means including a pressure medium discharge line in communication with said cylinder unit and a pressure relief valve in said discharge line.

3. The apparatus of claim 2, further characterized by (a) said piston and cylinder unit being annular and positioned within said threaded nut.

4. The apparatus of claim 3, further characterized by (a) said pressure medium is grease.

5. The apparatus of claim 4, further characterized by (a) said pressure relief valve is positioned outside the cooling area of said cast strand path.

6. The apparatus of claim 5, further characterized by (a) a rotatable annular spacer cylinder surrounding said spindle;

(b) said spacer cylinder extending between said annular piston and cylinder unit and one of said opposed supporting elements; and (c) cooperating means on said spacer cylinder and said one opposed supporting element for axially displacing said spacer cylinder relative to said one opposed supporting element in one peripheral position of rotation of said spacer cylinder.

7. The apparatus of claim 6, further characterized by (a) U-shaped adapters for insertion in the adjustable spacing between said opposed supporting elements around each of said plurality of connecting means.

* * * * *